United States Patent [19]

Wakamiya et al.

[11] Patent Number: 4,661,430

[45] Date of Patent: Apr. 28, 1987

[54] DEVELOPING METHOD AND INSULATING NONMAGNETIC TONER THEREFOR

[75] Inventors: Katsutoshi Wakamiya, Yokohama; Toru Matsumoto, Tokyo; Masuo Yamazaki, Kawasaki, all of Japan

[73] Assignee: Canon Kabushiki Kaisha, Tokyo, Japan

[21] Appl. No.: 637,791

[22] Filed: Aug. 6, 1984

[30] Foreign Application Priority Data

Aug. 12, 1983 [JP] Japan ..... 58-147360

[51] Int. Cl.[4] ..... G03G 13/22

[52] U.S. Cl. ..... 430/120; 430/122

[58] Field of Search ..... 430/97, 120, 122, 138

[56] References Cited

U.S. PATENT DOCUMENTS 4,363,861 12/1982 Nakamura et al. ..... 430/122
4,439,510 3/1984 McLoughlin ..... 430/138
4,533,617 8/1985 Inoue et al. ..... 430/111

FOREIGN PATENT DOCUMENTS 207053 12/1983 Japan ..... 430/138

*Primary Examiner*—John L. Goodrow
*Attorney, Agent, or Firm*—Fitzpatrick, Cella, Harper & Scinto

[57] ABSTRACT

A developing method, which comprises arranging a latent image-bearing member which bears a latent image on the surface and a toner-carrying member which carries an insulating non-magnetic toner at the developing section with a certain gap provided therebetween, coating the toner-carrying member with the insulating non-magnetic toner, conveying the resultant coated layer to the developing section while regulating the thickness thinner than said gap and developing the latent image on the latent image-bearing member under the application of an alternate electric field on the toner. Since the toner has a form of a microcapsule comprising a soft core material and a hard shell material and also contains a colorant in addition to the core material, adequate discharging can be effected during triboelectric charging to give an image with a constant density through stably charged state.

5 Claims, 2 Drawing Figures

DEVELOPING METHOD AND INSULATING NONMAGNETIC TONER THEREFOR

BACKGROUND OF THE INVENTION

This invention relates to a method for developing electrostatic images formed on an electrostatic image-bearing member, particularly to a method for development by forming a thin and uniform toner layer on a member for carrying toner (hereinafter frequently called also as "developer" without discrimination) and also to a toner to be used for the method.

In the prior art, the following methods have been known as the method for carrying out development by use of a one-component non-magnetic toner.

One method comprises providing a movable developer-carrying means which carrys, conveys and feeds a developer to a latent image-bearing member, a developer-feeding means and a movable coating means which receives feed of the developer from the developer-means and applies the developer to the above movable developer-carrying means, said movable coating means having a fiber brush for carrying the developer on its surface and contacting the above movable developer-carrying means to apply the toner uniformly to the above movable developer-carrying means at the contacted portion, while moving at higher speed in the same direction as the movable developer-carrying means than the movable developer-carrying means, and approaching the coated layer to the electrostatic latent image portion. Another method comprises providing a rotatable magnetic roller for forming a magnetic brush by attracting magnetic carriers for charging one-component non-magnetic toner particles and a developing roller for developing electrostatic latent images on an electrostatic latent image-bearing member by transfer of the toner particles onto the roller, and developing the electrostatic images, while maintaining a gap between the electrostatic image-bearing member and the developing roller, with the gap being set greater than the thickness of the coated toner layer on the developing roller. Still another method known in the art comprises arranging a developer-carrying member carrying a developer on its surface so as to face an electrostatic image-bearing member, thereby developing electrostatic images on the image-bearing member, wherein the developer accumulated in a developer-storing means below the developer-carrying member is drawn up onto the developer-carrying member, while giving vibration to the developer only at the drawing-up position to activate the developer and form a developer layer to a desired thickness on the surface of the developer-carrying member, thereby developing the electrostatic images on the electrostatic image-bearing member. As the steps after development, similarly as in the electrophotographic method known in the art, the toner developed on the electrostatic image-bearing member is transferred onto a transfer material such as paper, followed by fixing by an energy of heat, pressure, or heat and pressure.

The energy required for fixing is preferably as small as possible. In recent years, as a toner fixable at a low pressure or a low temperature, a microcapsule toner has been proposed, in which a hard resin is applied by coating around the cores of a soft or low melting binder containing a dye or pigment dispersed therein. However, when such a microcapsule is provided for use in the developing methods employing one-component non-magnetic developer as described above, the following difficulties are encountered. That is, in the case where a toner of the prior art prepared according to the crushing method by melting and kneading a binder resin and a dye or pigment, cooling and crushing the mixture, followed by classification, is used for the above developing method, triboelectric charges between the toner and the movable developer-bearing member will increase with the time of friction but, after reaching a certain quantity of charges, the surface charges on the toner are discharged through the dye or pigment exposed at the toner surface or through the tips of projections at the toner surface. Consequently, when the toner according to the crushing method is provided for use in the above developing method, the triboelectric charges of the toner can be maintained constant as the result of equilibrium established between charging of the toner due to friction with the movable developer-carrying member and discharging, whereby the image density of the copy may also be maintained constant. On the other hand, when a microcapsule toner is employed, because the toner surfaces are covered with a resin, there is substantially no surface for discharging, after the toner is charged through friction with a movable developer-carrying member. For this reason, the amount of charging of the toner cannot easily reach an equilibrium value within a short time, with the result that the image density of the copies obtained will disadvantageously be lowered with time.

Also, the microcapsule toner comprising cores having a dye or pigment dispersed in a soft binder or a low melting binder coated therearound with a hard resin is influenced by the soft binder or low melting binder core, even if surface-coated with a hard resin, and therefore inferior in free flowing property as compared with the toner obtained by the crushing method, because of stronger adhesive force between toners. Accordingly, the toner as a whole can hardly be subjected to uniform triboelectric charging through uniform friction with the movable developer-carrying member without irregularity. As the result, a part of the toner was insufficiently charged and liable to be attached onto the non-image portion of a resultant copy to cause a disadvantageous phenomenon of so-called fogging.

SUMMARY OF THE INVENTION

An object of the present invention is to provide a developing method by use of a low energy fixing type microcapsule toner which has remedied the above drawbacks.

Another object of the present invention is to provide a developing method by use of a low energy fixing type microcapsule toner, in which the image density will not be lowered with increase in the number of copying.

Still another object of the present invention is to provide a developing method by use of a low energy fixing type microcapsule toner which can provide a copied image without fogging or staining at the ground portion.

These objects of the present invention can be accomplished by a developing method, which comprises arranging a latent image-bearing member which bears a latent image on the surface and a toner-carrying member which carries an insulating non-magnetic toner at the developing section with a certain gap provided therebetween, coating the toner-carrying member with the insulating non-magnetic toner, conveying the resultant coated layer to the developing section while regulating the thickness thinner than the gap and developing the latent image on the latent image-bearing member under the application of an alternate electric field on the toner, wherein said insulating non-magnetic toner is in the form of a microcapsule comprising a core material containing a colorant and a shell material also containing a colorant.

The function of the toner and the method of the present invention may be considered as follows. Thus, by incorporating a dye or pigment in both the core binder and the shell material, when the toner is charged through friction with the developer-carrying member to be increased in triboelectric charges to reach a certain level of charges, the charges accumulated will be discharged through the dye or pigment exposed at the surface of the shell material, and the discharging and triboelectric charging reach an equilibrium to make the triboelectric charges constant, whereby the image density becomes constant.

Also, by permitting a dye or pigment to be present in the shell, the strength of the shell can be increased and the free flowing property of the toner is improved, whereby the toner as a whole can undergo triboelectric charging uniformly through friction with the developer-carrying member to give no toner with extremely small amount of triboelectric charges and therefore no fogging phenomenon occurs.

DETAILED DESCRIPTION OF THE INVENTION

Figure 1:
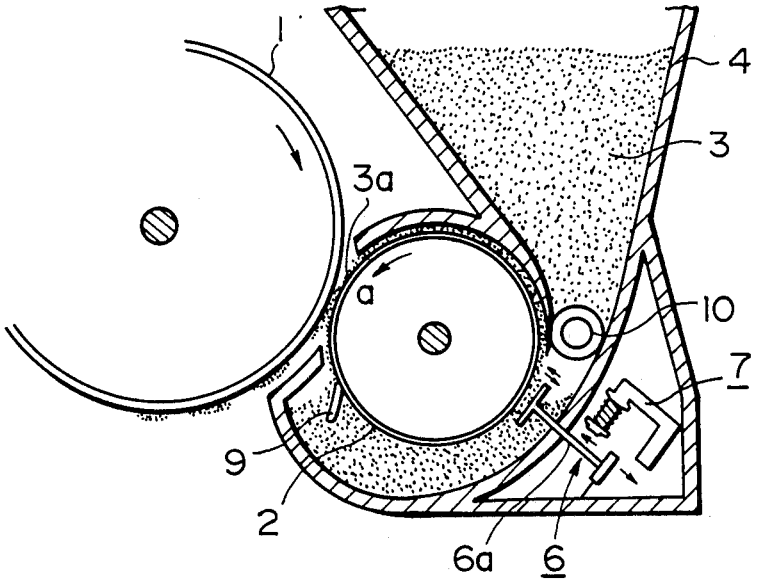
FIG. 1 is a transverse side sectional view of a device for practicing the developing method according to the present invention.

The microcapsule toner to be used in the present invention has a mean particle size preferably of 3 to 20 microns, more preferably of 5 to 10 microns, of which the thickness of the shell material is preferably 0.01 to 2 microns, more preferably 0.1 to 0.3 micron, with the remainder comprising substantially the core material coated with the shell material. According to the present invention, each of these core material and the shell material contains a colorant in an amount of preferably 1 to 30 wt. %, more preferably 5 to 15 wt. %.

The core material usable in the present invention is a material which can be easily deformed and fixed with a low energy of heat or pressure. Typical examples are substances having hydrocarbon chains which are called wax or various kinds of resins or compound having low melting points, which may also contain a small amount of a solvent or a dispersant. More specifically, they include polyolefins such as polyethylene, polypropylene, polytetrafluoroethylene, etc.; ethylene-acrylic copolymer; polyethylenevinyl acetate; polyester; styrene resins such as polystyrene, styrene-butadiene copolymer, styrene-acrylic copolymers, etc.; higher fatty acids such as palmitic acid, stearic acid, lauric acid, etc.; polyvinyl pyrrolidone; phenolterpene copolymer; polymethylsilicon; maleic-acid-modified phenol resin; methyl vinyl ether-maleic anhydrice copolymer; and others.

Mixtures of these core materials and colorants are made into fine particles, for example, by a method in which they are kneaded under heating by a conventional kneading means such as roll mill, kneader, homomixer, etc., and crushed after cooling; a method in which they are dissolved in a hot solvent, followed by spray-drying; a method in which they are sprayed under molten state; or a method in which they are emulsified in hot water, followed by cooling and drying.

The shell material which covers the soft solid core material may include, for example, polymers or copolymers of styrene or its derivative such as polystyrene, poly-p-chlorostyrene, polyvinyltoluene, styrene-butadiene copolymer, styrene-acrylic acid copolymer, styrene-maleic anhydride copolymer, etc.; polyester resins; acrylic resins; xylene resins, polyamide resins, ionomer resins, furan resins, ketone resins, terpene resins, phenol-modified terpene resins, rosin, rosin-modified pentaerythritol ester, natural resin-modified phenol resins, natural resin-modified maleic acid resins, cumarone-indene resins, maleic-acid-modified phenol resins, alicyclic hydrocarbon resins, petroleum resins, cellulose phthalate acetate, methyl vinyl ether-maleic anhydride copolymer, starch-grafted polymer, polyvinyl butyral, polyvinyl alcohol, polyvinyl pyrrolidone, chlorinated paraffin, wax, fatty acid and so on. These can be used either singly or as a mixture.

The colorant may be added to the shell material of the present invention according to, for example, a method in which a core material is dispersed in a dispersion of a colorant in a solution of the shell material resin and the resultant dispersion is subjected to spray drying; a method in which a colorant is attached around the core material and dispersed in a solution of shell-forming resin, and a solvent which is miscible with the solvent of the resin solution but a poor solvent for the resin is added to cause precipitation of the resin around the core; etc.

The colorant to be used for coloration of the core material and the shell material may include black colorants such as Carbon Black, Nigrosine dye, Lamp Black, Sudan Black SM, etc.; yellow colorants such as Fast Yellow G, Benzidine Yellow, Pigment Yellow, etc.; red colorants such as Indofast Orange, Irgazine Red, Paranitroaniline Red, Toluidine Red, Carmine FB, Permanent Bordeaux FRR, Pigment Orange R, Risol Red 2G, Lake Red C, Rhodamine FB, Rhodamine Lake, etc.; blue colorants such as Methyl Violet B Lake, Phthalocyanine Blue, Pigment Blue, Brilliant Green B, Phthalocyanine Green, etc.; Oil Yellow GG, Zapon Fast Yellow, Kayaset Y 963, Kayaset YG, Sumiplast Yellow GG, Zapon Fast Orange RR, Oil Scarlet, Sumiplast Orange G, Orazol Brown B, Zapon Fast Scarlet CG, Aizenspiron Red BEH, Oil Pink OP, and so on.

The colorants to be added into the core material and the shell material may be different but are usually the same or similar.

For preparation of the capsule toner of the present invention, various encapsulation techniques known in the art may be available. For example, it is possible to use the spray drying method, the interfacial polymerization method, the coacervation method, the phase separation method, the in-situ polymerization method or the methods as disclosed in U.S. Pat. Nos. 3,338,991, 3,326,848 and 3,502,582.

Referring now to the accompanying drawings, specific examples of the capsule toner of the invention and the working examples of the developing method of the present invention by use thereof are to be described below.

EXAMPLE 1

| | |
|---|---|
| Polyethylene (AC-6, produced by Allied Chemical, Inc.) | 95 wt. parts |
| Phthalocyanine Blue | 5 wt. parts |

The above composition was kneaded on a hot roll mill, and sprayed under a molten state of 150° C. by means of a spray dryer having an inlet temperature of 180° C. and an outlet temperature of 80° C. to obtain a core material with particle sizes of 1 to 30 microns. The core material was classified by use of a wind force classifier to obtain particles of core material with sizes of 5 to 20 microns.

One kilogram of the above classified core material was dispersed in a dispersion of 50 g of phthalocyanine blue dispersed in 4 liters of a 2% solution of a styrene-methyl methacrylate copolymer (10:30, MW:300,000) in toluene, and the dispersion was spray dried by means of a spray dryer at an inlet temperature of 150° C. and an outlet temperature of 50° C. As the result, a microcapsule toner with a narrow particle size distribution, having soft core material with a mean particle size of 11 microns comprising 5 wt. % of Phthalocyanine Blue dispersed in polyethylene coated with a styrene-methyl methacrylate copolymer containing 5 wt. % Phthalocyanine Blue dispersed therein to a thickness of 0.3 microns was obtained.

This capsule toner was placed in a copying machine equipped with the developing device as shown in FIG. 1 and subjected to an copying operation. Thus, the above microcapsule toner 3 in a hopper 4 was fed through a toner feeding member 10. Further, a vibrating member 6 having a permanent magnet 5*a* was vibrated by an electromagnet 7 at a frequency of 50 Hz and an amplitude of 0.2 mm, and a non-magnetic sleeve 2 was rotated at 120 mm/sec., whereby a uniform coated layer 3*a* of the toner with a thickness of about 50 microns was formed on the sleeve. The non-magnetic sleeve 2 and the electrostatic image-bearing member 1 were arranged face to face with a gap of about 300 microns maintained therebetween, and copying was performed while giving the non-magnetic sleeve 2 a bias alternate electric field of a frequency of 100 Hz to several KHz with a minus peak value of −660 to −1200 V and a plus peak value of +400 to +800 V. As the result, a clear image of high image density without fog could be obtained.

When successive copying was conducted for 2,000 sheets, the initial image density was 1.20, while the image density after 2,000 sheets of copying was stably 1.21. Also, no attachment of the toner on the ground portion was observed.

COMPARATIVE EXAMPLE 1

When successive copying was conducted for 2,000 sheets with the use of a toner prepared by encapsulation according to the same procedure as in Example 1 except for adding no colorant to the shell material, the initial image density was 1.25, but it was lowered with the continuation of copying, until it became 0.85 on copying of 2,000 sheets. Also, attachment of the toner was observed on the ground portion.

EXAMPLE 2

When successive copying was conducted for 2,000 sheets with the use of a toner obtained by encapsulation according to the same procedure as in Example 1 except for changing the colorant dispersed in the core material and the shell material to Pigment Yellow, clear images without ground staining or fog could be obtained. The image densities at the initial stage and after 2,000 sheets of copying were found to be 1.23 and 1.25, respectively.

EXAMPLE 3

| | |
|---|---|
| Polyethylene (AC-8, produced by Allied Chemical, Inc.) | 95 parts |
| Carbon Black (#44, produced by Mitsubishi Kasei K.K.) | 5 parts |

The above composition was kneaded on a hot roll mill, cooled and crushed by a jet mill to obtain powder of a core material with particle sizes of 1 to 30 microns. These particles were classified by means a wind force classifier to obtain core particles of 5 to 20 microns.

One hundred parts by weight of the core particles were mixed with 2 parts by weight of Carbon Black by means of a Henschel mixer to have Carbon Black attached around the core particles.

One hundred grams of the core particles having Carbon Black attached on the surfaces were dispersed in 500 ml of a 2% solution of a styrene-dimethylaminoethyl methacrylate copolymer (90:10, MW:100,000) in DMF. While stirring the dispersion by means of a homomixer (Autohomo M-type, produced by Tokushu Kika Kogyo K.K.), 200 ml of deionized water was added dropwise at a rate of 5 ml/min., thereby effecting precipitation of the resin around the core material particles, to prepare a capsule toner having Carbon Black particles dispersed in the shell material.

Figure 2:
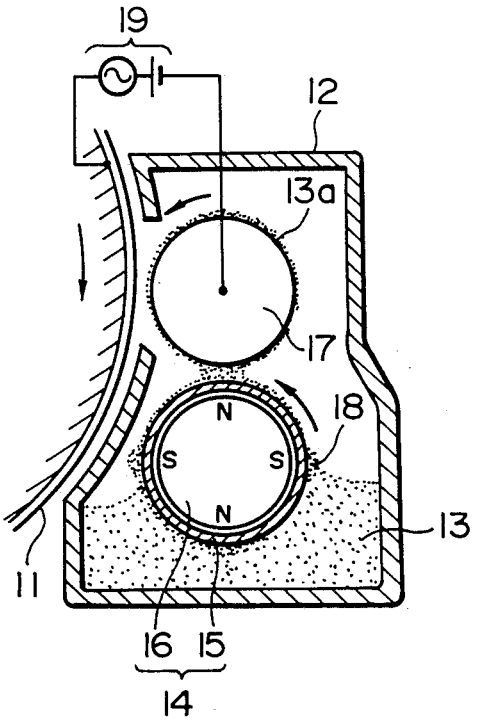
FIG. 2 is a transverse side sectional view of another device for practicing the developing method according to the present invention.

The above toner was mixed with iron powder (EFV 250–400 mesh, produced by Nippon Teppun K.K.) at a proportion of 10 wt. % to prepare a developer, and copying operation was performed by means of a copying machine equipped with the developing device as shown in FIG. 2.

More specifically, electrostatic latent images were formed on an image-bearing member 11 according to a known electrophotographic method. Separately, the above microcapsule toner 13 contained in the housing 12 of the developing device was permitted to contact and be rubbed with a magnetic roller 14 having a movable non-magnetic sleeve 15 provided around a fixed magnet 16, whereby the toner accompanying a magnetic brush 18 of the iron powder carrier was transferred to a developing roller 17 by application of an alternate/direct superposed voltage by a power source 19 to form a toner layer 13*a* with a thickness of 80 microns. Further, while maintaining a gap between the developing roller 17 and the electrostatic image-bearing member 11 at 300 microns, a voltage with peak values of −700 V and +200 V was applied therebetween from the power source 19 by adding a direct current component of −250 V to the alternate current waveform with frequency of 200 Hz and peak values of +250 V. As the result, images could be obtained with a high image density and a good gradation through jumping of the toner layer onto the image-bearing member 11.

Also, in successive copying test for 2,000 sheets, no lowering in image density was observed. No attachment of the toner on the ground portion was observed, either.

What is claimed is:

1. A developing method, which comprises:

(a) arranging a latent image-bearing member which bears a latent image on the surface and a toner-carrying member which carries an insulating non-magnetic microcapsule toner at the developing section with a gap provided therebetween, said insulating non-magnetic microcapsule toner comprising a core material containing 1 to 30 wt. % of a colorant and a shell material containing 1 to 30 wt. % of a colorant, said shell material having a thickness of 0.01 to 2 microns;

(b) coating said toner-carrying member with said insulating non-magnetic microcapsule toner by either a vibrating coating means or a magnetic brush coating means, (c) conveying the resultant coated layer to the developing section while regulating the thickness of said coated layer thinner than said gap; and (d) developing the latent image on the latent image bearing member under the application of an alternate electric field with said insulating non-magnetic microcapsule toner.

2. A developing method according to claim 1, wherein said core material and shell material each contain 5 to 15 wt. % of a colorant.

3. A developing method according to claim 1, wherein said toner has a mean particle size of 3 to 20 microns.

4. A developing method according to claim 1, wherein the core material and the shell material contain colorants of the same color.

5. A developing method according to claim 1, wherein the latent image on the latent image bearing member is developed with the insulating non-magnetic microcapsule toner under the application of a bias alternate electric field of a frequency of 100 Hz or higher with a minus peak value of −660 to −1200 V and a plus peak value of +400 to +800 V.

* * * * *